United States Patent [19]

Reiter

[11] 4,166,202

[45] Aug. 28, 1979

[54] SWITCH ACTUATING MECHANISM

[76] Inventor: John J. Reiter, 6521 Stevens Ave. South, Minneapolis, Minn. 55423

[21] Appl. No.: 874,401

[22] Filed: Feb. 1, 1978

[51] Int. Cl.[2] ..... H01H 9/28; H01H 3/16

[52] U.S. Cl. ..... 200/44; 200/61.58 R

[58] Field of Search ..... 200/44, 50 A, 61.58 R

[56] References Cited

U.S. PATENT DOCUMENTS

| | | | |
|---|---|---|---|
| 2,830,143 | 4/1958 | Koopman | 200/44 |
| 3,312,799 | 4/1967 | Reiter | 200/61.58 R |

*Primary Examiner*—Steven L. Stephan

*Attorney, Agent, or Firm*—Orrin M. Haugen; Thomas J. Nikolai

[57] ABSTRACT

A switch actuating mechanism for use with electrically powered machine tools or related equipment which includes an electrical junction box in which is mounted an "on-off" toggle-type switch, the box having pivotally mounted thereon a broad surface member which is mechanically linked to the toggle lever of the switch. A releasable latch normally holds the broad surface member in a first orientation in which the switch is in its "off" position, but when manually operated, it permits the broad surface member to be swung to a second orientation in which the toggle lever is moved to the switch "on" position. An inward force anywhere on the broad surface member will move the switch lever back to its "off" position and relatch the broad surface member to the junction box. Further included is a key operated lock which is arranged to prevent unauthorized personnel from actuating the switch from its "off" to its "on" position.

4 Claims, 3 Drawing Figures

SWITCH ACTUATING MECHANISM

BACKGROUND OF THE INVENTION

I. Field of the Invention

This invention relates generally to a safety device for power tools and more specifically to a switch actuating mechanism which may be conveniently positioned with respect to the machine being controlled for permitting an operator to conveniently and safely connect or disconnect electrical power to or from the machine.

II. Description of the Prior Art

In my earlier Reiter U.S. Pat. No. 3,312,799, there is described a switch actuating mechanism comprising an "on-off" type toggle switch which is adapted to be operatively connected in circuit with an electrical motor for controlling the flow of current thereto. A broad surface member in the form of a U-shaped panel is pivotally mounted in proximity to the operator's station and this member is mechanically linked to the lever of the toggle switch. Because a relatively large surface area is used to actuate the switch, a latch arrangement is provided which releasably retains the panel in its closed position. As is pointed out in the aforereferenced Reiter patent, inadvertent actuation of the panel is unlikely to occur in that the latch must be disengaged at the same time that the panel member is tipped to cause the switch to be turned on.

The instant invention is considered to be an improvement over my prior invention. Instead of an elongated, open framework which exposes the working parts to possible damage and also to the collection of sawdust and other debris, the switch actuating mechanism of the present invention utilizes a substantially sealed enclosure. Also, rather than mounting the ON-OFF switch at an extreme right or left position as in my prior arrangement, the switch has been relocated to a more central location with respect to the broad surface member, which is a more mechanically efficient location. A further modification and improvement over my earlier invention results from the manner in which the pivot points for the broad surface member have been constructed. In my earlier invention, as described in the aforementioned U.S. Pat. No. 3,312,799, the pivot connection to the elongated frame of the broad surface member was at the edges of the surface member which dictated that the broad surface member could only be as wide as the frame. In the present invention, this objection has been overcome, all as will be further set forth.

SUMMARY OF THE INVENTION

In accordance with the teachings of the present invention, there is provided a generally rectangular box-type housing having a cover member pivotally secured at one edge thereof to the front of the housing. A broad surface member is attached to this pivotable cover by screws such that the broad surface member can be any practical size irrespective of the dimensions of the box-like enclosure itself. Contained within the housing at a generally central location is an electrical toggle-type switch, the electrical contacts of which are adapted to be connected in a suitable circuit arrangement with the drive motor of the power tool and the source of electrical power. A mechanical linkage is coupled to the switch actuating lever of the toggle-type switch and to the pivotable cover member also at a generally central location such that when the cover is in its closed position, the toggle-type switch will be "off." However, when the cover member is rotated away from the box, the mechanical linkage exerts a force on the switch actuating lever to cause the switch to be turned on.

A slidable shield device is incorporated between the upper edge of the pivotable cover member and the top surface of the box-like enclosure, such that the box remains sealed to dust and debris irrespective of the position of the pivotable cover member.

As in the above referenced Reiter Patent, a latch mechanism is provided for releasably holding the cover member in its closed position relative to the housing. To cause the motor to be energized, the operator must consciously and simultaneously release the latch and pivot the cover member outwardly. Once the switch is turned on, it may be returned to its off position by the operator as by bumping the broad surface member with his thigh or knee. In doing so, the cover member is again latched to the housing and may not be inadvertently restored to the circuit on condition.

Another improved feature of the present invention is the incorporation of a key-operated lock which is operatively disposed between the housing and the pivotable cover member. Unauthorized personnel, i.e., personnel not in possession of the key, are prevented from actuating the "on-off" switch in that the cover is held in the switch-off position until the lock is unlocked.

It is accordingly a principal object of the present invention to provide a new and improved switch actuating mechanism for power tools.

Another object of the invention is to provide a unitary, self-contained switch actuating mechanism which may be mounted as a unit on a power tool.

Still another object of the invention is to provide a new and improved switch actuating mechanism for use with power tools which embodies a key operated lock arranged to prevent unauthorized use of the equipment on which the invention is installed.

These and other objects and advantages of the present invention will become apparent to those skilled in the art from a detailed description of the preferred embodiment when considered in conjunction with the accompanying drawings in which like numerals in the several views refer to corresponding parts.

DESCRIPTION OF THE PREFERRED EMBODIMENT

Figure 1:
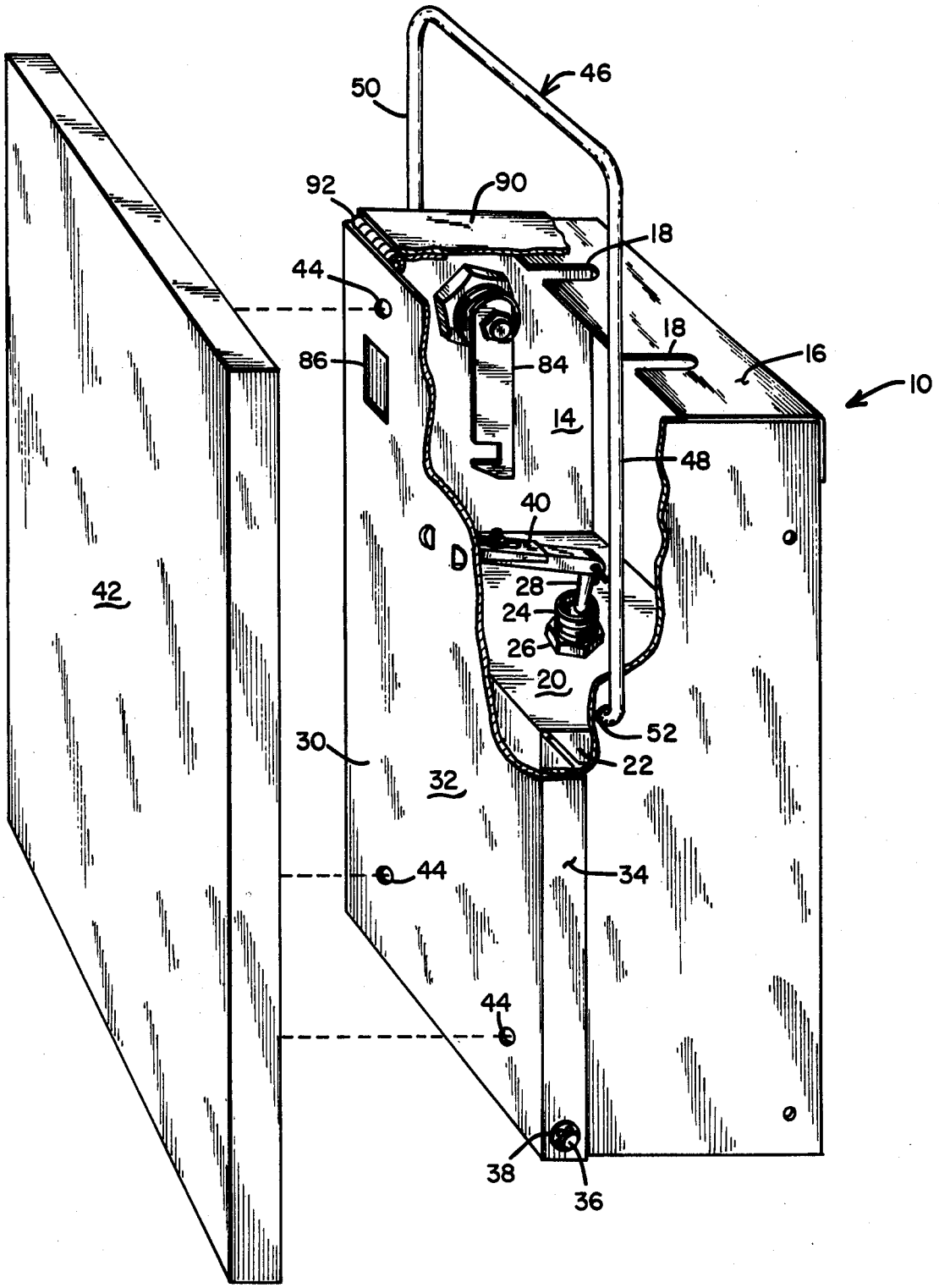
FIG. 1 is a perspective view of the preferred embodiment which is partially broken away to better illustrate internal working parts thereof.

Referring first to FIG. 1, there is indicated generally by numeral 10 the switch actuating mechanism of the present invention. As is indicated, the switch actuating mechanism 10 comprises a generally rectangular housing having opposed side walls 12 and 14 which are in parallel and spaced apart relationship with respect to one another. A top plate 16 extends between the side walls 12 and 14 is fixedly attached thereto. The housing is preferably fabricated from sheet aluminum or steel. However, other materials such as plastic may be conveniently utilized, provided applicable fire codes are complied with. The cover plate 16 is slotted as at 18 for a purpose which will be further explained later on in this specification. Also extending between the opposed side walls 12 and 14 and located a predetermined distance below the cover plate 16 is a generally horizontal shelf 20 having perpendicularly extending edge portions as at 22 which are affixed to the inside surfaces of the side walls 12 and 14. Generally centrally positioned on the shelf 20 is an aperture through which the crown 24 of a toggle-type electrical switch passes. The switch may be of the type described in my co-pending application Ser. No. 854,136, filed Nov. 23, 1977. However, other types of toggle switches may also be used so that limitation is not intended. The switch may be held in place with respect to the shelf 20 by means of a threaded nut 26. Extending outwardly from the upper end of the crown 24 is a switch actuating toggle lever 28.

A cover member 30 which is generally in the form of a channel having a front surface 32 and integrally formed, perpendicularly extending side edges 34. The width and height dimension of the front surface 32 are such that the side edges 34 extend outwardly from the outer side surfaces of the side members 12 and 14 with a predetermined clearance therebetween. The cover member 30 is pivotally secured to the side walls 12 and 14 of the housing by means of a pin 36 which is arranged to pass through mating apertures formed through the edges 34 and the side walls 12 and 14. The pin 36 may be held in place by means of compression type fasteners 38.

Suitably affixed to the surface 32 of the cover member 30 is a linkage or arm 40 which extends inwardly and is pivotally coupled at its other end to the upper end portion of the switch lever 28. The length of this arm 40 is adjusted such that when the cover plate 30 is in a first orientation in a closed relationship with respect to the mating side walls of the housing, the switch lever 28 will be in the "off" position of the switch whereby no current may flow therethrough from a source to a load. However, when the cover member 30 is pivotally rotated in a counterclockwise direction when observed in FIG. 1 about the pivot pin 36, the arm 40 will pull the switch actuating lever 28 from its "off" to its "on" position whereby a current path is established from the source to load.

Also illustrated in FIG. 1, but in exploded fashion, is a broad surface member 42 which may take the form of a rectangular panel. This panel may be fabricated from wood or alternatively may be plastic or other suitable material, the sole requirement being that it provide a broad surface area against which the machine operator may react. The panel member 42 is arranged to be attached to the front surface 32 of the cover plate 30 as by screws or other suitable fasteners passing through the apertures 44 formed in the front surface 32 of the cover 30. Because it is the cover plate 30 which is hinged to the side walls 12 and 14 of the box, rather than the panel comprising the broad surface member, there is no practical limitation on the area of the broad surface member as was the case in my earlier patented structure.

Also indicated in FIG. 1 is a generally U-shaped wire bail 46 having parallel legs 48 and 50 which are spaced apart by a distance slightly greater than the outside width dimension of the housing. The ends of the legs 48 and 50 are bent inwardly so as to extend through apertures 52 formed in the right and left side walls 12 and 14, respectively. As will be more fully explained hereinbelow, the U-shaped bail 46 comprises a latch actuating lever for releasing the cover member 30 with respect to the housing.

Figure 2:
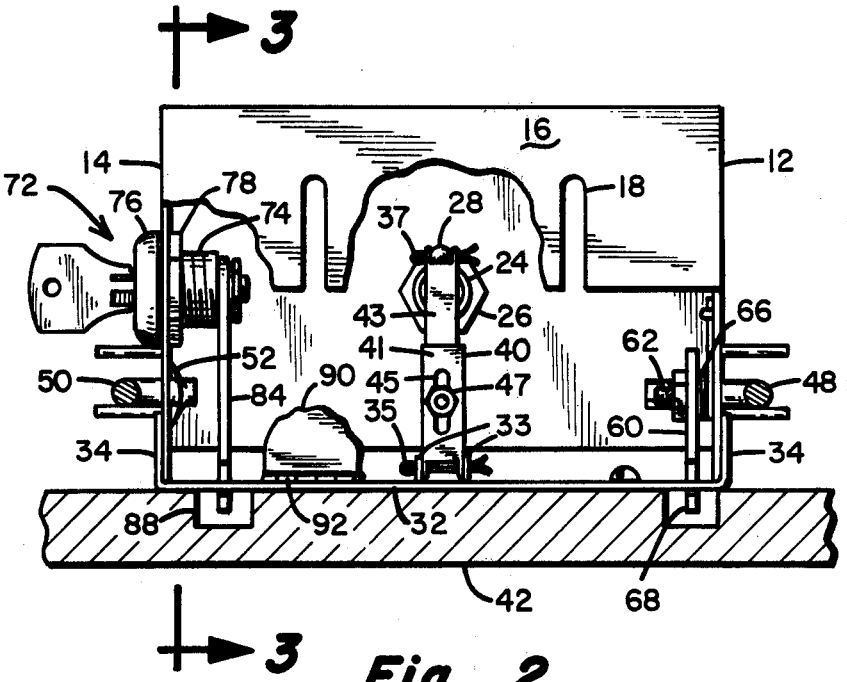
FIG. 2 is a top view of the preferred embodiment.

With reference to FIG. 2, it can be seen that the end of the bail leg 50 is held in place by means of a compression-type spring fastener 52. The inwardly extending end portion of the bail leg 48 has a side surface thereof flattened and attached to this flattened portion by means of a screw 54 is an upwardly extending strap 56 which cooperates with a leg portion 58 of a latch member 60. The latch member 60 is pivotally attached to the side wall 12 of the housing by means of a screw 62 which passes through an oversized hole 64 formed in the latch member 60.

As can best be seen in the view of FIG. 2, a torsion-type spring 66 surrounds the screw 62 and is operatively coupled between the side wall 12 and the latch member 60 to normally urge the barb 68 of the latch in an upward orientation. As is shown in FIG. 3, when the barb 68 is in this upward orientation and the cover plate 32 is closed with respect to its housing, it passes through a rectangular slot or opening formed in the cover plate and engages the outer side surface of the cover plate 32.

Figure 3:
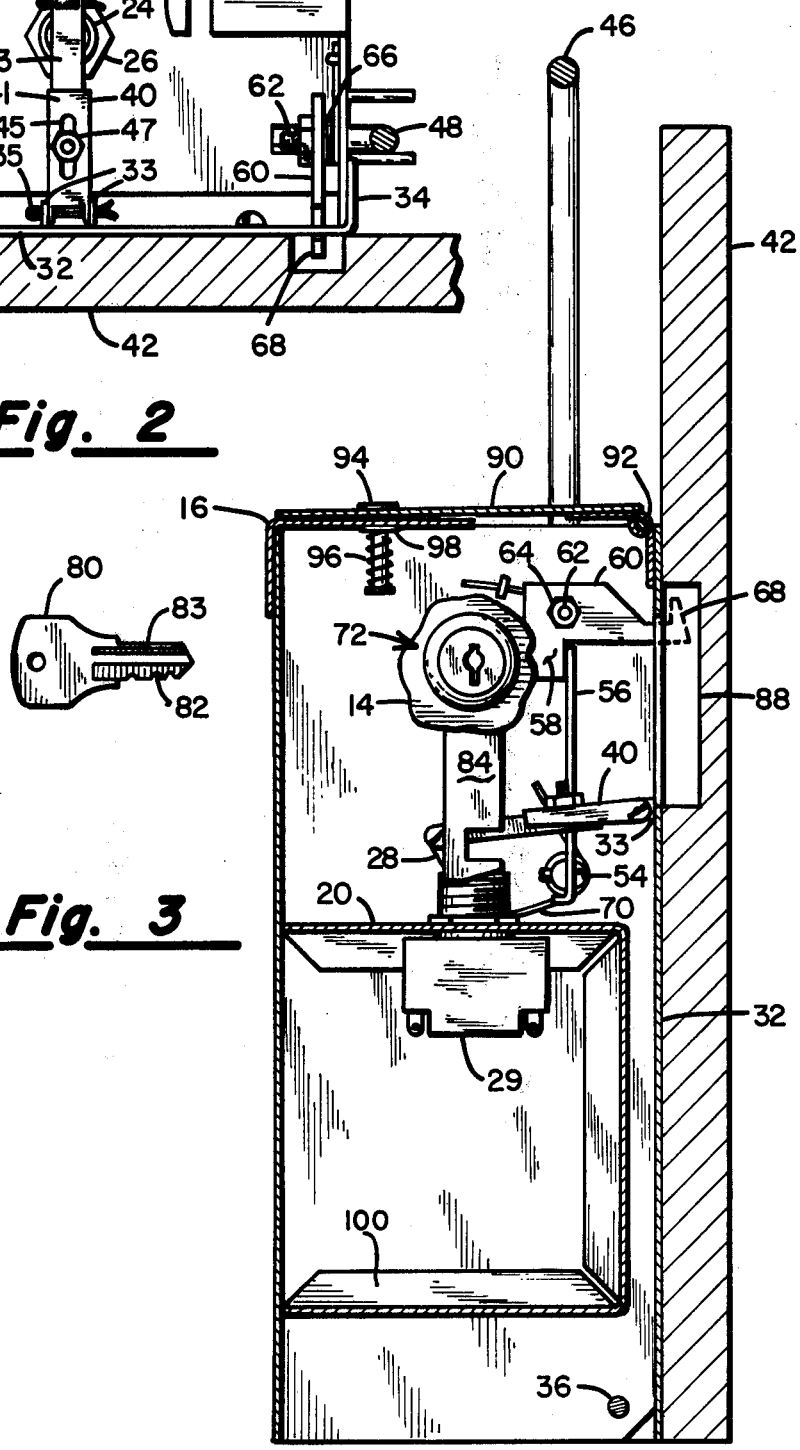
FIG. 3 is a side cross-sectional view taken along the lines 3—3 in FIG. 2.

A second torsion-type wire spring 70 is wrapped about the inwardly extending end of the bail leg 48 and cooperates with the strap 56 and the upper surface of the shelf 20 to normally urge the bail 46 in a clockwise direction when observed in the view of FIG. 3. Thus, it can be seen that when the bail 46 is pushed in the counterclockwise direction against the force of the spring 70, the strap 56 will engage the leg 58 of the latch 60 causing the barb 68 to move in a downward direction so as to no longer engage the outer surface of the cover plate 32. Thus, the operator may, by applying a clockwise force against the inside surface of the panel 42, cause the panel and the cover plate 32 to which it is attached to rotate about the pivot pin 36. In doing so, the switch actuating lever 28 is moved from its "off" position as illustrated in FIG. 3 to its "on" position by way of the arm 40. As has already been mentioned, this serves to energize the electric motor with which the switch actuating mechanism of the present invention is utilized.

In order to again turn off the motor, the operator may use his knee, thigh or other convenient body part to press against the outwardly facing surface of the panel member 42. This force will cause the inside surface of the cover member 32 to abut the sloping portion of the barb 68 causing the latch 60 to rotate in a clockwise direction when viewed in FIG. 3 until the barb 68 again passes through the rectangular slot formed in the cover plate 32. Once the barb 68 clears the edge of the slot, it will again snap in a counterclockwise direction under the force of the torsion spring 66. The cover plate 32 and its adjoining panel member 42 will remain in this locked orientation until the switch actuating lever bail 46 is again operated as previously described.

As can best be seen in the view of FIG. 2, the arm 40 comprises a two-piece assembly of two overlapping channels 41 and 43. Each of these channels is slotted as at 45 to permit lateral adjustment in the length thereof. Once the desired length is established, they can be locked together by means of a nut and bolt assembly 47. Still with reference to FIG. 2, it can be seen that a convenient way of attaching the arm 40 to the inner surface of the cover plate 32 is to form two inwardly extending ears 33 as by punching. These ears 33 have an aperture extending through them so that a cotter pin 35 may be used to couple the arm segment 41 to the panel. In a similar fashion, the arm extension 43 may be coupled to the switch actuating lever 23 by means of a cotter pin 37 which is made to pass through suitable apertures formed in the extension 43 and the toggle lever 28.

In order to prevent unauthorized use of the power tool with which the present invention is utilized as its switch actuating mechanism, a key operated lock assembly indicated generally by numeral 72 is provided. With reference to FIG. 2, it can be seen that the lock arrangement comprises a generally tubular outer casing 74 having a shoulder 76. The casing 74 is arranged to pass through a circular opening formed in the side wall 14 of the housing, the hole being too small to permit the passage of the shoulder 76 therethrough. The outer surface of the casing 74 is threaded to accept a locking nut 78 which securely holds the lock assembly 72 in engagement with the side wall 14. Disposed within the casing 74 is a rotatable tumbler assembly (not shown). Only when a key as at 80 having the appropriate notches 82 and groove pattern 83 to actuate the tumbler assembly is inserted in the keyway, as illustrated in FIG. 2, can the inner tumbler assembly be rotated. Operatively coupled to an extension of the rotatable tumbler assembly is a latch arm 84. Appropriately located in the surface 32 of the cover plate 30 is a second rectangular opening 86 (FIG. 1) through which the end portion of the latch lever 84 is adapted to pass when rotated from the unlatched position to the latch position. The panel member 42 is also provided with a recess 88 which is generally aligned with the rectangular opening 86 so that the end portion of the latch lever 84 may freely pass through the opening. The lock arrangement is designed such that once the key is removed from its keyway, the tumbler assembly remains locked to its outer casing and the latch lever 84 is also rendered immovable.

In order to prevent sawdust or other debris from falling into the housing of the switch actuating mechanism, it may be desirable to include a shield member 90 which may be hingedly attached along one edge thereof to the upper edge of the cover plate 32 by means of a hinge member 92. The opposite edge of the shield plate 90 remains unattached and overlaps the top plate 16 by a sufficient amount so that the pivotal travel of the cover plate 32 does not expose the interior of the housing to falling debris. In order to insure a tight fit between the mating surfaces of the cover plate 16 and the hinged shield 19, pins 94 (FIG. 3) are press fitted into apertures formed in the hinged shield 90 and the stem thereof and pass through the slots 18 formed in the cover plate 16. A compression-type coil spring 96 surrounds the stem of the pins 94 and urges a washer 98 upward against the undersurface of the plate 16, thus yieldably squeezing the shield plate 94 against the top plate 16.

With reference to FIG. 3, it can be seen that the box-like enclosure defined by the side walls 12 and 14 and the top plate 18 contains a second shelf 100 which is located parallel to and beneath the shelf 20. This shelf 100 has an aperture therethrough (not shown) such that electrical wires including power conductors and motor leads may be brought into the box for connection to the electrical terminals of the switch 29. When used to control the starting and stopping of an electrical motor, the shelf 100 provides a convenient mounting surface for the conventional motor control relay (also not shown). The motor control relay generally has a coil and a plurality of normally open and at least one normally closed contacts. The coil would be connected in series with contacts of the switch 29 and between the power terminals such that a momentary closure thereof will cause the coil to be momentarily energized. This momentary energization, in turn, causes a first set of normally open contacts to close to latch the coil in an energized state, such that it will continue to be energized, even when the contacts of switch 29 reopen. Additional control relay contacts close to connect the motor terminals across the power terminals.

The motor thus remains running until the operator applies a force normal to the exposed surface of the member 42 to again toggle the switch 29 to its "off" position. This breaks the series circuit including the relay coil and allows its contacts to reopen and de-energize the motor and unlatch the switch holding contacts.

It is also obvious that additional circuit components may be mounted on either the shelf 20 or the shelf 100. For example, if the system with which the switch actuating mechanism 10 is used employs so-called "dynamic braking," the conventional braking resistor, which is adapted to be coupled across the armature winding of the motor when the control relay is de-energized, may also be mounted within the box-like enclosure, preferably on the shelf 20 or the shelf 100.

It will, of course, be understood that various changes may be made in the form, details, arrangements and proportions of the parts. For example, rather than utilizing a toggle-type switch which is mechanically linked to the pivotable cover member 32 by an arm 40, it is obvious that short-stroke Microswitch ® devices may be mounted within the box-like enclosure and be electrically connected in circuit with a motor control relay. The arcuate movement of the broad surface member 42 can be made to actuate the Microswitch devices in a desired fashion. The scope of the invention should therefore be determined in accordance with the appended claims.

What is claimed is:

1. A safety device for electrically powered equipment, comprising:

(a) a box-like housing structure having opposed generally rectangular side walls spaced apart from one another by a top member, a bottom wall and an intermediate wall oriented generally parallel to said bottom wall;

(b) an electrical switch having an actuator movable between an "open" position and a "closed" position mounted within said housing structure on said intermediate wall;

(c) a broad surface member pivotally attached between said side walls along an edge thereof proximate said bottom wall;

(d) a linkage coupling said broad surface member to said actuator;

(e) a generally "U"-shaped wire bail having spaced apart parallel leg members terminating in inwardly extending end portions which extend through said side walls to the interior of said housing and rotatable therein;

(f) an elongated strap member attached to one of said end portions and rotatable therewith;

(g) a spring biased latch pivotally mounted on one of said side walls and having a hook portion at one end for engaging said broad surface member and a projection at its other end adapted to abut said elongated strap such that when said bail member is rotated, said hook is disengaged from said broad surface member allowing said broad surface member to be pivotally moved from a first orientation with respect to said housing in which said switch actuator is in said "open" position to a second orientation in which said switch actuator is in said "closed" position; and (h) a key operated lock means, operable independently from said latch mechanism, coupling said broad surface member to said housing structure for preventing movement of said broad surface member from said first orientation to said second orientation until unlocked by said key.

2. Apparatus as in claim 1 wherein said key operated lock means comprises:

(a) a generally cylindrical casing attached to said housing;

(b) a tumbler assembly mounted within said casing and having a keyway formed therein, said tumbler assembly being non-rotatable within said housing except when a key is in said keyway; and (c) a second latch connected to said tumbler assembly and adapted to selectively engage said broad surface member.

3. Apparatus as in claim 1 wherein said linkage is pivotally attached at one end thereof to said actuating lever and at the other end thereof to said broad surface member.

4. Apparatus as in claim 1 and further including a shield plate hingedly attached to said broad surface member for movement therewith and extending over said top member for a predetermined distance.

* * * * *